US007100805B2

(12) United States Patent
Bulsink

(10) Patent No.: US 7,100,805 B2
(45) Date of Patent: Sep. 5, 2006

(54) AIR FRESHENER

(75) Inventor: Dirk Jan Bulsink, Leiden (NL)

(73) Assignee: Sara Lee/DE N. V., Utrecht (NL)

( * ) Notice: Subject to any disclaimer, the term of this patent is extended or adjusted under 35 U.S.C. 154(b) by 0 days.

(21) Appl. No.: 10/717,930

(22) Filed: Nov. 21, 2003

(65) Prior Publication Data

US 2004/0129736 A1 Jul. 8, 2004

(30) Foreign Application Priority Data

Nov. 22, 2002 (NL) ..... 1021979

(51) Int. Cl.
*B65D 83/06* (2006.01)
*B67D 5/06* (2006.01)

(52) U.S. Cl. ..... 222/403.1; 222/180

(58) Field of Classification Search ..... 222/180, 222/61, 402.1, 402.3, 402.25
See application file for complete search history.

(56) References Cited

U.S. PATENT DOCUMENTS 2,534,464 A * 12/1950 Marini et al. ..... 239/274
2,534,465 A * 12/1950 Marini ..... 239/274
3,224,644 A * 12/1965 Davis ..... 222/162
3,344,959 A * 10/1967 Faso ..... 222/183
3,858,762 A * 1/1975 Meshberg ..... 222/180
4,428,510 A 1/1984 Iglessias

FOREIGN PATENT DOCUMENTS

DE 2141275 3/1973

* cited by examiner

*Primary Examiner*—Michael Mar
*Assistant Examiner*—Sonia N. Khaira
(74) *Attorney, Agent, or Firm*—Pillsbury Winthrp Shaw Pittman LLP

(57) ABSTRACT

An air freshener for dispensing a spray of deodorant, includes a housing in which a holder can be received for containing deodorant. A sliding bar has an end in contact with a door or doorway, so that a door movement results in a movement of the sliding bar. A wedge-shaped press member is coupled with the sliding bar, which during a movement of the sliding bar causes the dispensing member to move in a direction transverse to the movement of the sliding bar. The sliding bar includes a guide along which the press member can be moved in a direction transverse to the sliding bar. The press member operates a coupling piece between the press member and the dispensing member, and the coupling piece includes a round upper side including a contact surface for the wedge-shaped press member.

20 Claims, 12 Drawing Sheets

AIR FRESHENER

BACKGROUND OF THE INVENTION

1. Field of the Invention

The invention relates to an air freshener for dispensing a spray of deodorant.

2. Description of the Related Art

From U.S. Pat. No. 3,858,762 it is known to utilize a tilting pawl which is moved over a wedge-shaped run-on surface. As a result, the dispensing member is pushed away from the sliding bar so that a spray dosage is dispensed. The lateral forces on the holder can be considerable due to the sliding movement of the pawl, so that the action of the mechanism may be disturbed or the holder may even be pressed out of the housing. This may be enhanced upon prolonged use, whereby the pawl may experience resistance to an increasing extent due to wear of the run-on surface. Further, these frictions will result in a relatively high noise level of the device during use.

SUMMARY OF THE INVENTION

It is an aspect of the present invention to form a solution to the above-mentioned problems. A further aspect is to provide a compact air freshener in one piece which is simple to mount, while the lateral forces on the holder are limited and the noise level is reduced.

In accordance with the above-mentioned aspects, the air freshener according to the present invention includes a housing mountable on or adjacent a door; the housing includes a holder configured to contain deodorant, a movable dispensing member, which upon movement dispenses a spray of deodorant from the holder; a sliding bar having an end in contact with the door or a doorway, so that movement of the door results in a movement of the sliding bar; and a press member, coupled with the sliding bar, having a wedge-shaped run-on surface, which during a movement of the sliding bar causes the dispensing member to move in a direction transverse to the movement of the sliding bar, wherein the sliding bar includes a guide along which the press member can be moved in a direction transverse to the sliding bar; which press member operates a coupling piece which is provided between the press member and the dispensing member, so that in operation a contact surface between press member and the coupling piece in a first movement of the sliding bar extends substantially parallel to the guide in order to fixate the press member transversely to the guide in a position remote from the sliding bar, and wherein the contact surface in a second movement, opposite to the first movement, is oriented substantially transversely to the guide, so that the press member is moved towards the sliding bar and wherein the coupling piece comprises a round upper side which constitutes a contact surface for the wedge-shaped press member.

By virtue of such a construction, the press member is not fixed relative to the sliding bar, but can move relative to it. Through the shape of the contact surface and the orientation of the guide, it is possible to obtain a dual function whereby in the first movement a depressing movement is performed by the press member, because it is fixed relative to the sliding bar, and in the second movement no depressing movement is performed, in that the guide is oriented transversely to the contact surface and the press member is moved along the guide away from the dispensing member. In the second movement, the dispensing member is not depressed but the press member is moved away from the dispensing member. As a result, in the second movement, the dispensing member is not activated by the press member. As a consequence, a distinction can be made between directions in which the sliding bar is pushed up by the door or doorway—the first movement; and a direction in which the sliding bar moves back to an original starting position—the second movement. Only in the first movement should sufficient force be produced to depress the press member; in the second movement a relatively light spring can move the sliding bar back to the starting position again. Furthermore, the coupling piece functions as transmission for transmitting the pressure force exerted by the press member, via the coupling piece onto the dispensing member. Through the presence of the coupling piece, lateral forces on the dispensing member are limited.

A wedge-shaped press member can in a first forward movement depress the coupling piece, with the wedge-shaped press member having a narrow side facing the coupling piece. The wedge slides, continuing the first forward movement, over the coupling piece and then has the wide side facing the cylinder. In a second, opposite movement, the wide side of the wedge is pressed against the coupling piece, so that the wedge is pushed up along the guide and the dispensing member is not depressed.

According to another aspect, the coupling piece is of rotatable design and includes an eccentric contact surface for making contact with the dispensing member. Such a configuration effects a stabilized movement whereby lateral movements are eliminated as much as possible. In this aspect, lateral is understood to mean a movement transverse to the main movement direction. As force is applied to the coupling piece in just one of the movement directions of the sliding bar, this movement can be neutralized relatively well with the above-mentioned eccentric contact surface.

The coupling piece may be of cylindrical design, with the holder including a guide surface and a recess contiguous to this guide surface, so that upon inclusion of the holder in the housing the coupling piece is pressed under counterpressure via the guide surface into the recess.

According to another aspect, the guide can include guide pins which are included in a guide slot, which guide slot is contiguous to a recess in which at least one guide pin can be included, while in operation the guide pin in the first movement is fixated in the recess and in the second movement is pushed out of the recess into the guide slot. The presence of such a recess increases the reliability as to the press member in effect remaining fixed during depression of the activation member.

According to another aspect, a holder for containing deodorant for inclusion in a housing of an air freshener according to any one of the above-mentioned aspects, in particular to a holder including a cap and a propellant holder, connected to the cap, the cap including a freely supported depressible dispensing member for dispensing a spray from the propellant holder. Such a holder can be designed to be detachable from the air freshener to enable its being fitted therein, optionally as a disposable element or refillable element.

Through the freely supported depressible dispensing member, lateral forces are diverted, so that a slight deviation from an axial depressing movement of the press element does not have a disturbing effect, in particular, that no obstruction or undue noise production occurs.

According to another aspect, the dispensing member include a recess into which a round lower side of a coupling piece can be pressed, which recess is contiguous to a flexible connecting element for forming a flexible suspension for the dispensing member. Through the flexible connecting element, the dispensing member is freely supported. The connecting element can comprise a substantially V-shaped flexible part which constitutes a connection between the dispensing member and a wall of the cap. The recess preferably has a width of about 4 mm, to receive a round coupling piece having a length of about 4 mm and a diameter of about 15 mm.

The cap can include a plate-shaped part which can engage in a slot provided in an air freshener housing. The plate-shaped part can enclose a casing which surrounds the propellant holder, while on the inner wall of the casing projections are provided which under counterpressure reach into a recess of the propellant holder. Through such a combination of a plate-shaped part and a casing, an form-retentive cap is provided, which can be connected virtually undetachably with the propellant holder.

The plate-shaped part can include a lip engageable by an operator for removing the holder from the housing. The lip may reach over an outlet piece of the dispensing member. Such a lip increases convenience of operation for the user for exchanging the holder. Preferably, the plate-shaped part has a transverse dimension of about 39 mm, with the lip having a longitudinal dimension of about 20 mm. The cylindrical part can have a diameter of about 15 mm and a length of about 4 mm.

BRIEF DESCRIPTION OF THE DRAWINGS

The present invention will be described with reference to the following drawings, in which.

DETAILED DESCRIPTION

Figure 1:
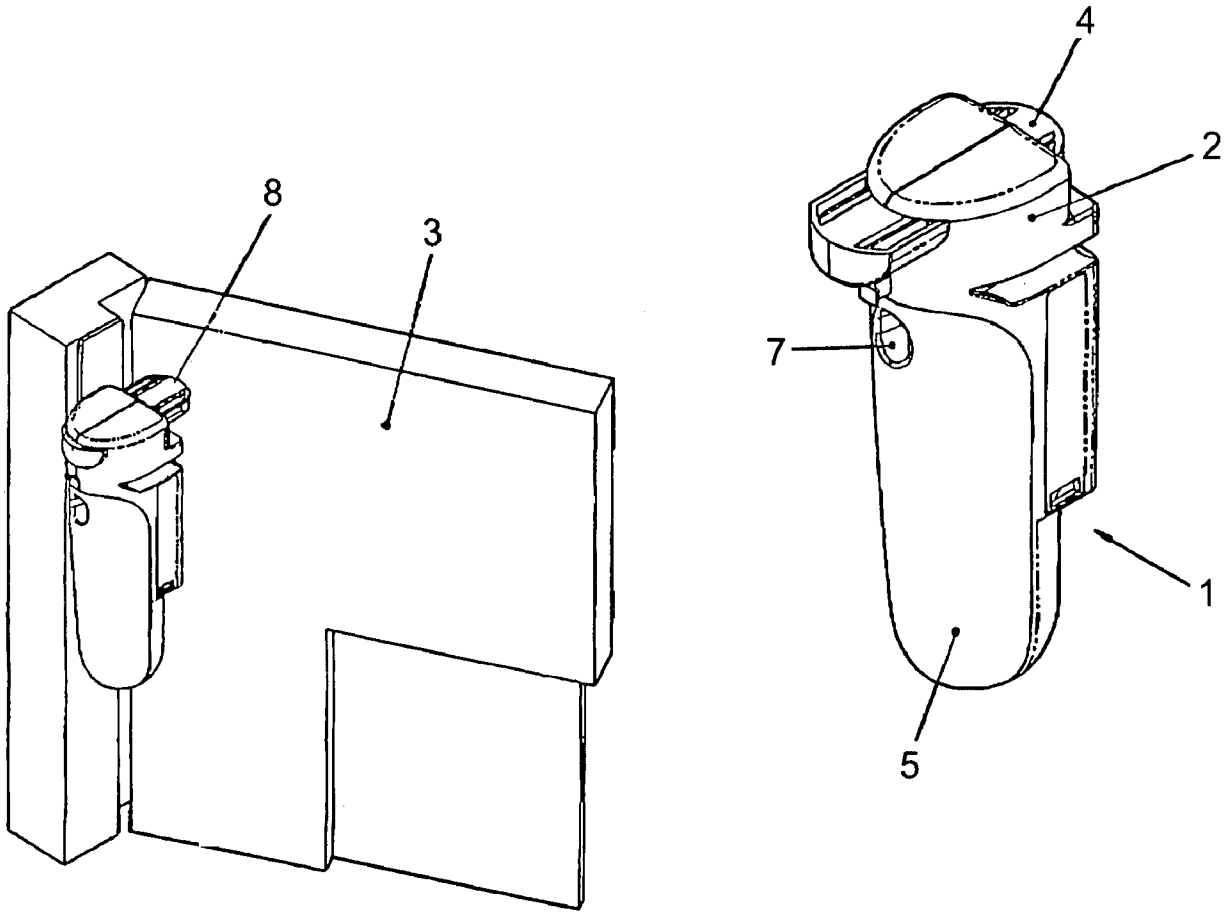
FIG. 1 is a schematic illustration of an air freshener and the mounting thereof adjacent a door according to the present invention.

Referring to FIG. 1, an air freshener 1 includes a housing 2, which can be mounted next to or on a door 3, optionally with the aid of a mounting plate (not shown), so that a door movement engages a sliding bar 4 which upon movement activates the air freshener 1. The housing 2 contains a holder 6 (see FIGS. 8 and 9) concealed from view by a screen plate 5. The holder 6 upon activation dispenses a spray through an opening 7 provided in the air freshener 1. The holder 6 can be loosely accommodated in a housing and be refillable. The holder 6 may also be a disposable holder. Preferably, use is made of propellant holders. The sliding bar 4 has an end 8 in contact with the door 3. In operation, the door moves the sliding bar 4 from an extended to a retracted position, whereby during the movement from the extended to the retracted position a spray is dispensed by the air freshener 1.

Figure 2:
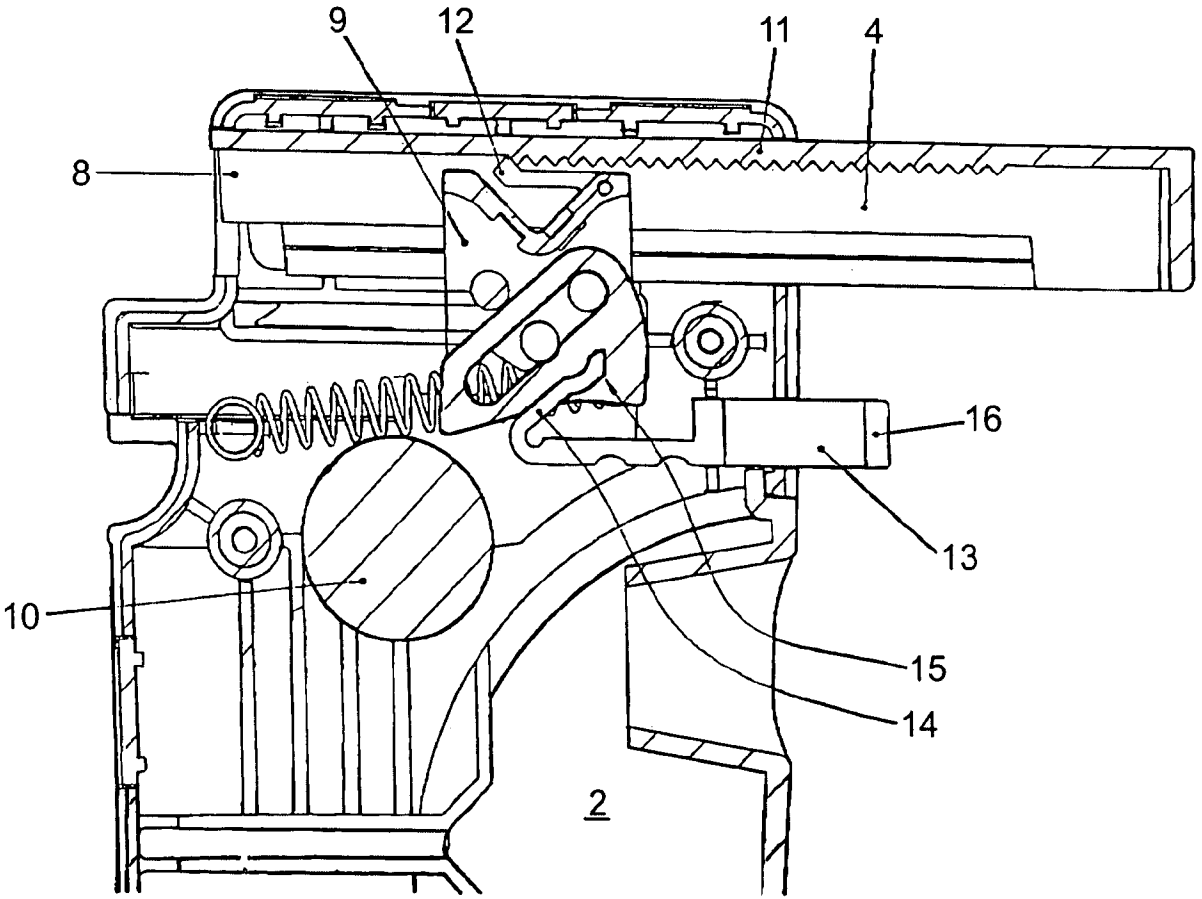
FIG. 2 is a schematic side elevation view of the sliding bar mechanism of the air freshener according to the present invention before it is set.
Figure 3:
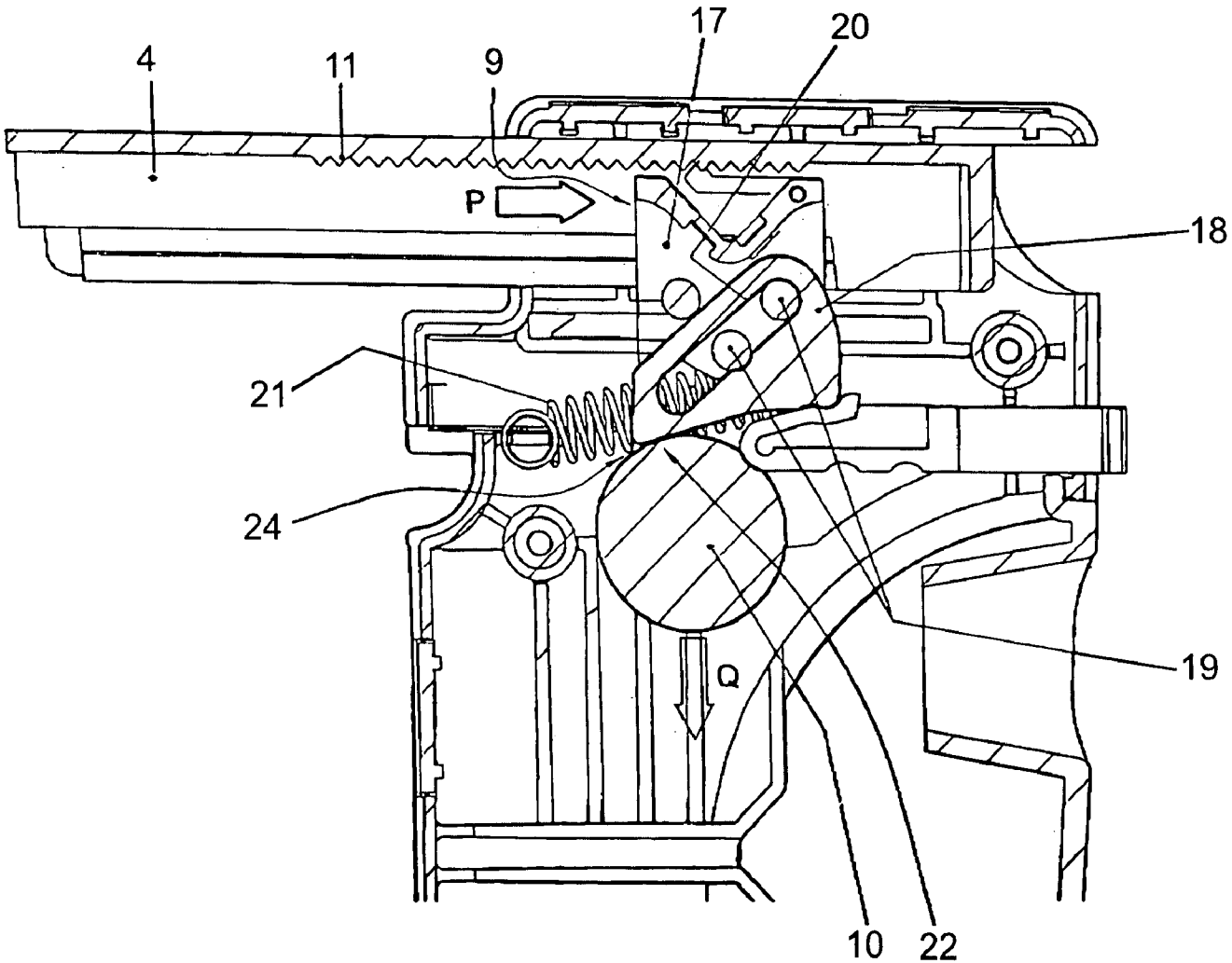
FIG. 3 is a schematical side elevation view of the sliding bar mechanism in a condition wherein the dispensing member is activated.
Figure 7:
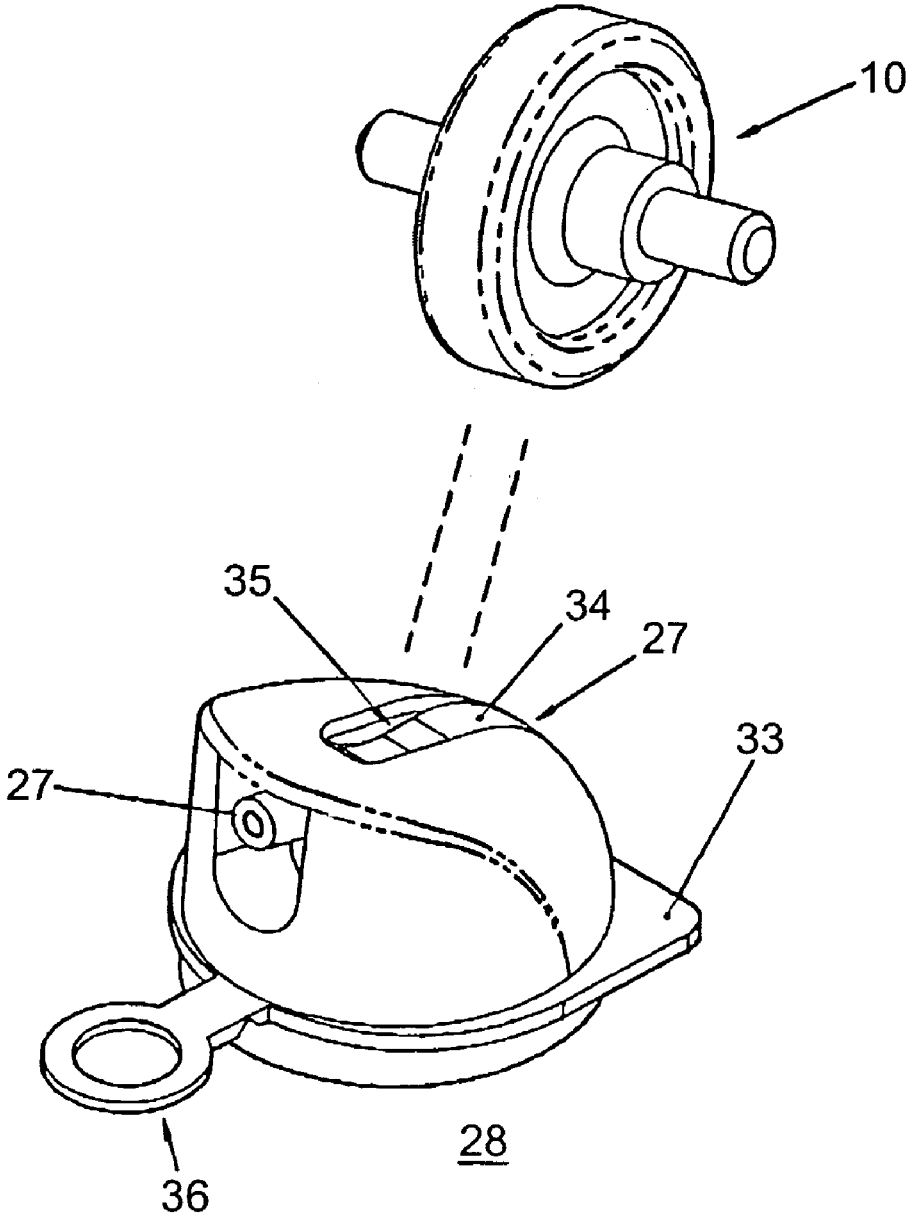
FIG. 7 is a schematic illustration of disassembled parts of a cap of the holder and the coupling piece for transmitting the depressing movement of the press member to the cap.

Referring to FIG. 2, the sliding bar 4 is accommodated in the housing 2 and arranged to move through the housing 2. In the sliding movement, the bar 4 carries along a press member 9 which is arranged to depress a coupling piece 10, as shown in FIG. 3. The coupling piece 10 transmits the depressing movement to the holder 6, as shown in FIG. 7.

Initially, at installation, the press member 9 is set relative to the end 8 of the sliding bar 4 by a toothed strip 11 along which the press member 9 can be shifted. This shift takes place under bias of a resilient lip 12 that engages the toothed strip 11. The press member 9, optionally supported by a blocking member 13, is held in a fixed position relative to the housing 2.

The blocking member 13 includes a lip 14 that engages in a slot 15 of the press member 9. The sliding bar 4 is pushed on until the end 8 touches the door 3, while the press member 9 is held in position by the blocking member 13. The air freshener 1 can thus be set for the specific dimensions of the door 3 and doorway. By pushing a knob 16 of the blocking member, the lip 14 is pushed out of the slot 15, the blocking is removed and the press member 9 can be carried along by the sliding bar 4.

Referring to FIG. 3, the sliding bar 4, during a sliding movement in a first direction P, carries the press member 9 which, now that the blocking has been removed, is fixed at a fixed position relative to the end of the sliding bar 4. The press member 9 includes a guide 17 and a wedge 18. The wedge 18 is movable relative to the guide 17. The guide 17 includes guide pins 19 accommodated in the guide 17. A guide slot 20 is formed in the wedge 18. The guide slot 20 can move along the guide pins 19.

The press member 9, as a result of the door movement, moves along and over the coupling piece 10, so that the wedge 18 presses the coupling piece 10 during the forward sliding movement in the first direction P, in a second direction Q, which is oriented substantially transversely to the first direction P.

Figure 5A:
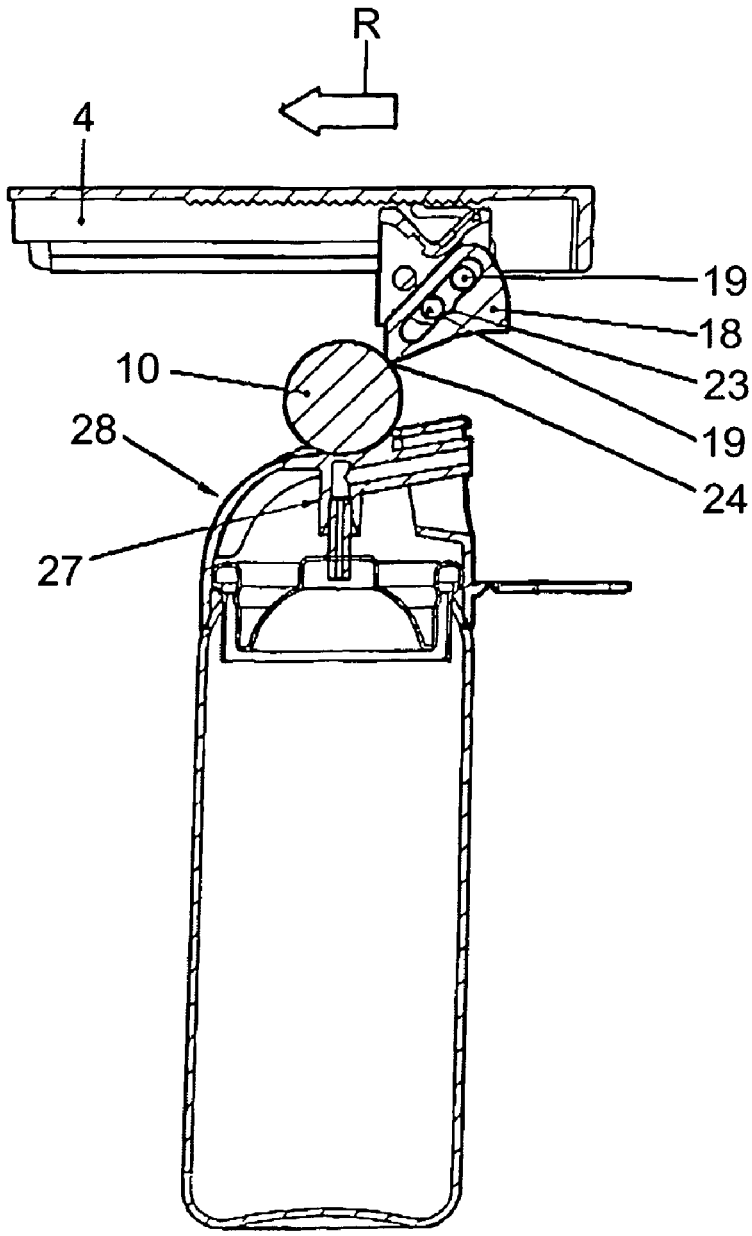
FIGS. 5*a–c* are schematic side elevation views of the sliding bar mechanism where the press member, during a backward movement, in successive views, is moved over the dispensing member without activating it.

The sliding bar 4 moves under the force of a spring 21 to a first position, shown in FIG. 5*a*, and can be moved back from this position by the door.

The guide 17 is fixed on the sliding bar 4 by the toothed strip 11. Accordingly, by virtue of the guide 17, the relative position of the press member 9 relative to the end 8 is substantially fixed, but the wedge 18 can still make a transverse movement relative to the sliding bar 4. As a consequence, the wedge 18 can be held, in the forward movement P, in a position remote from the sliding bar 4, relatively close to coupling piece 10. As further shown in FIGS. 5*a–c*, in the return movement the wedge 18 can move along the guide pins 19 towards the sliding bar 4, so that the press member 9 is relatively spaced from the coupling piece 10 and the coupling piece 10 is not depressed.

Through the orientation of the guide 17 relative to the sliding bar 4 and the coupling piece 10, the wedge 18 can move back and forth. In operation, a contact surface 22 between the press member 9 and the coupling piece 10 extends substantially parallel to the guide slot 20. As used herein, "substantially parallel" means at least: a direction parallel to the longitudinal axis of the guide 17 or at a slight angle relative thereto, for example, an angle up to about 25°. The angle should be set such that a normal force exerted by the contact surface 22 does not effect any movement in the direction of the guide 17. The angle may increase if in the guide 17 a guide slot 20 is provided having a recess 23, shown in FIG. 6. The angle may also increase if the friction between the guide pins 19 and the slot 20 is relatively large.

Through the round shape of the coupling piece 10, the contact surface 24 in the return movement, which is opposite to the movement represented by arrow P, is oriented substantially transverse to the guide slot 20, so that the press element is moved to the remote position. As used herein "substantially transverse" means at least a direction extending so transversely relative to the longitudinal axis of the guide slot 20, for instance at an angle of about 60° or more, i.e. transversely to such an extent, that a normal force exerted by the contact surface 24 effects a movement of the wedge 19 along the longitudinal axis of the guide slot 20. The angle may be smaller if the friction between the guide pin 19 and the slot 20 is relatively small.

Further, as used herein, "contact surface" means at least a surface that defines a tangent plane between the wedge 18 and the coupling piece 10 at a point where the coupling piece 10 and the wedge 18 are in contact with each other. This contact surface therefore extends substantially parallel to the tangent plane of the wedge 18 and/or the coupling piece 10 and is designated in the forward movement by reference numeral 22 and in the backward movement by reference numeral 24.

Figure 4:
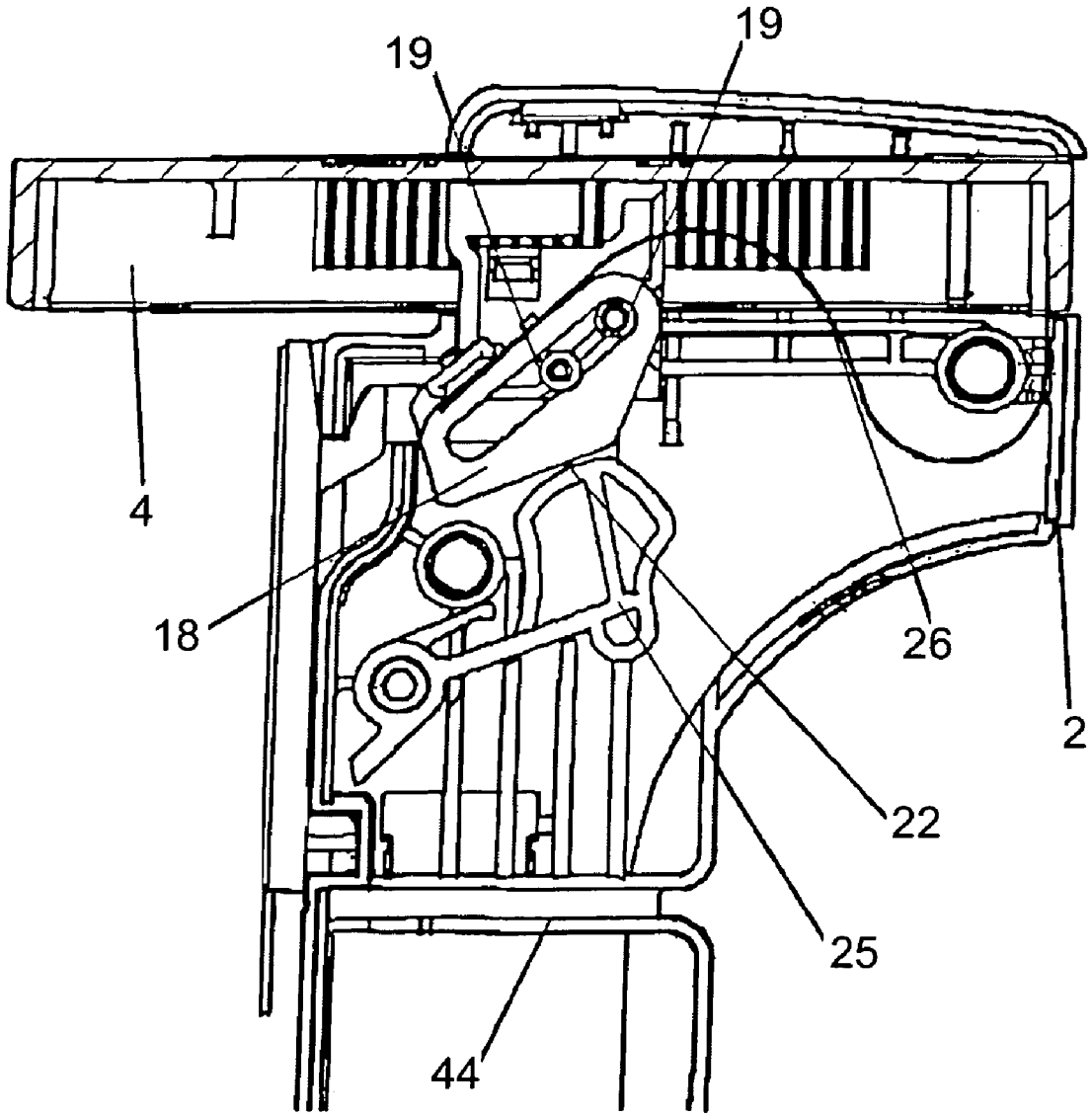
FIG. 4 is a schematic illustration of an alternative embodiment of the sliding bar mechanism.

FIG. 4 shows another embodiment of the sliding bar mechanism of the air freshener 1. The sliding bar mechanism includes a sliding bar 4 and a wedge-shaped element 18 which can be moved along guide pins 19. The coupling piece is a hammer-shaped member 25 including a round contact surface 22 for contact with the wedge-shaped element 18. The forces are therefore transmitted in a substantially identical manner to that described with reference to the embodiment shown in FIGS. 2 and 3.

Due to the hammer-shaped member 25 being rotatable, tangential forces that are exerted on the contact surface 22 upon the run-on sliding movement of the wedge-shaped element 18 are taken up and the movement of the coupling piece is stabilized. This results in an improved operation as the forces can be transmitted more smoothly to the dispensing member 27 (see FIG. 5*a*). As a result, a lower sound level of the device 1 in operation can be achieved. For further reducing the noise, and to improve the operation of the wedge-shaped element 18, the spring for moving the sliding bar back is in this embodiment a leaf spring 26 which is coupled between the housing 2 and the sliding bar 4. By the leaf spring 26, the sliding bar 4 is pushed into position, and no stop is needed for limiting the extreme extended position. This leads to improved sound reduction compared with the spring configuration of FIGS. 2 and 3. The leaf spring 26, as it extends along the upper side of the wedge-shaped element 18, also always moves the wedge-shaped element 18 to the position remote from the sliding bar 4, and thereby supports gravity.

Figure 5B:
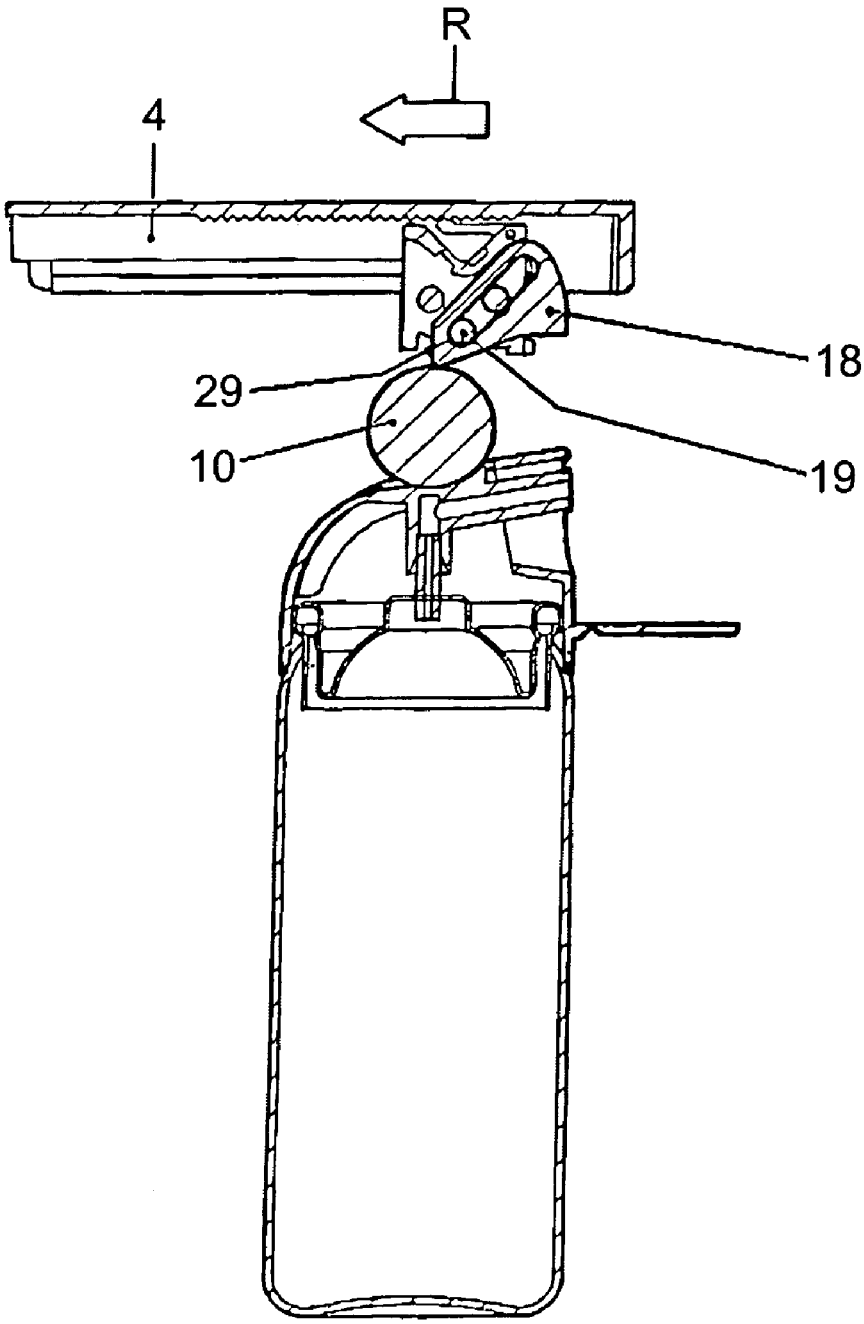
Figure 5C:
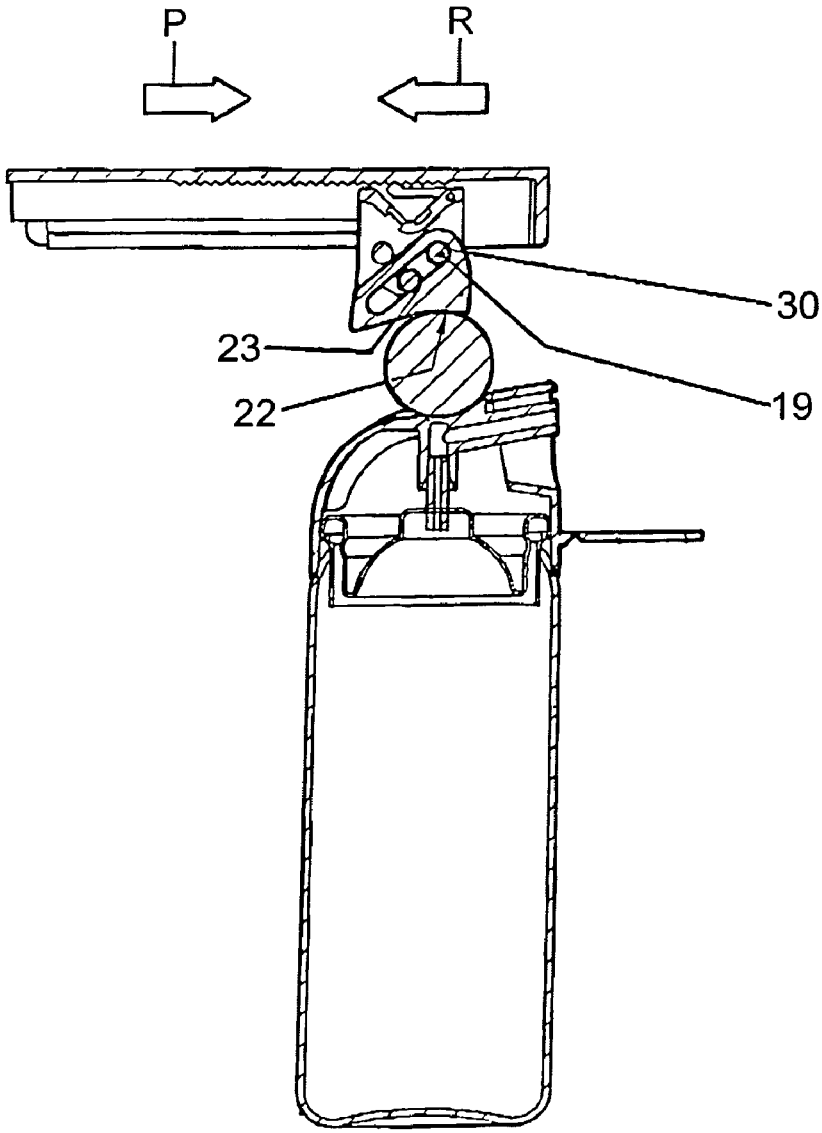

FIGS. 5*a–c* illustrate how the wedge 18 in the return movement, represented by arrow R, is moved over the coupling piece 10. In FIG. 5*a*, the wedge 18 is still on the right-hand side of the coupling piece 10 and has already been pushed slightly upwards, as evidenced by the positioning of guide pins 19 already disposed half out of the recess 23. The coupling piece 10 is of cylindrical design and it operates the dispensing member 27, which upon depression dispenses a spray. The dispensing member 27 is included in a cap 28 (see FIG. 7), and is supported therein stiffly so that it does not move in the return movement, and hence the coupling piece 10 does not move either, so that the wedge-shaped element 18 under counterpressure of the contact surface 24 is pushed up along the guide pins 19 in the direction of the sliding bar 4.

FIG. 5*b* illustrates, in a continued movement following arrow R, from the position shown in FIG. 5*a*, how the wedge-shaped element 18 is disposed at the highest point, i.e. in a position removed maximally relative to the coupling piece 10 and minimally relative to the sliding bar 4. The guide pins 19 are then situated at an extreme lowermost position 29 in the guide slot 20, i.e. the wedge has been maximally moved up along the guide pins 19.

FIG. 5*c*, finally, illustrates the starting position of the wedge-shaped element 18, where the wedge-shaped element 18 has been brought over the highest point of the coupling piece 10 and has shifted back down again, as evidenced by the position of the guide pins 19, which are now in the extreme upper position 30. Through the action of gravity, optionally supported by a bias element (not shown), the wedge-shaped element 18 has been pushed down, so that the wedge-shaped element 18 has its contact surface 22 resting on the coupling piece 10. Upon reversal of this movement, i.e. when the moving direction along arrow R is changed into arrow P, the lowermost guide pin 19 will be pushed into the recess 23 again, so that a cycle repeats itself and the wedge-shaped element 18 can be moved in fixed position over the coupling piece 10.

Figure 6:
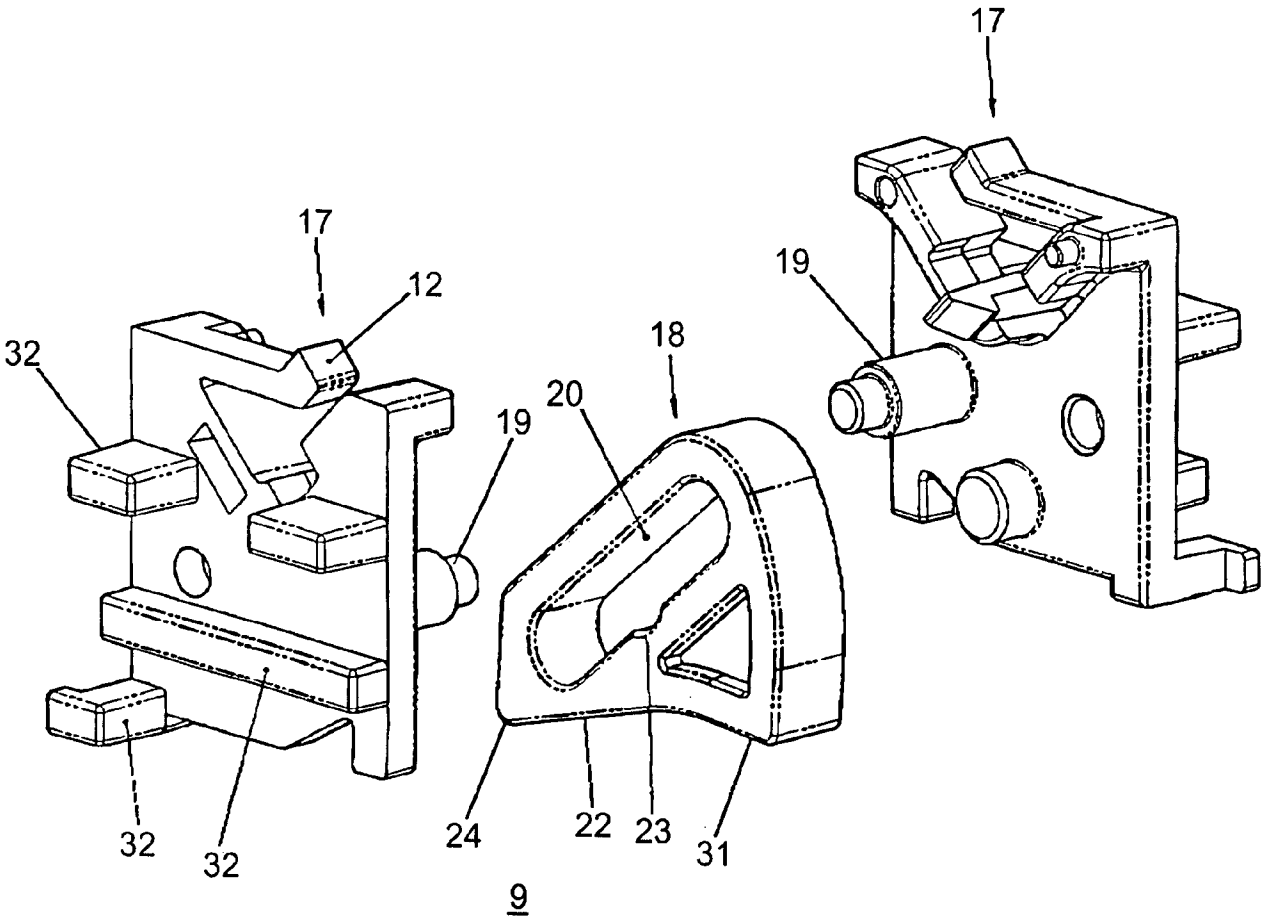
FIG. 6 is a schematic illustration of disassembled parts of the press member according to the present invention.

FIG. 6 shows a view of disassembled parts of the press member 9. The press member 9 includes two parts of relatively antisymmetrical design, the guide 17 and the wedge-shaped element 18. The wedge-shaped element 18 includes a contact surface 31 substantially horizontal with respect to an operatively mounted condition, which contact surface 31 is in contact with the coupling piece 10 when the wedge-shaped element 18 is brought into the starting position, i.e., the position from which the wedge-shaped element 18 effects the depressing movement of the coupling piece 10. Further, the wedge-shaped element includes a contact surface 22, already discussed, that increases in height viewed from the direction of the sliding bar 4, and a second relatively smaller contact surface 24 that is oriented substantially transversely to the first contact surface 22 and forms at least one engagement point for pushing the wedge-shaped element 18 up along the guide pins 19. The guide 17 comprises, in addition to the pins 19, an assembly of guide parts 32 configured to move along a slot (not shown) provided in the sliding bar 4, and a resilient lip 12, already discussed with reference to FIG. 2, for setting the guide 17 relative to the end 8 of the sliding bar 4.

In the wedge-shaped element 18, the guide slot 20 is provided, along which the guide pins 19 can move. In the guide slot 20, a recess 23 is provided which is capable of fixing the guide pin 19 in the slot 20 in the forward movement, when the wedge 18 depresses the coupling piece 10.

FIG. 7 shows a preferred embodiment of the coupling piece 10 and how it engages the dispensing member 27. The coupling piece 10 is preferably of cylindrical design and has a round side at least at the top and at the bottom. The coupling piece 10 is mounted in the housing 2 and can be depressed by the wedge-shaped element 18. The dispensing member 27 is included in a flexible cap 28 having attached thereto a plate-shaped part 33. The plate-shaped part 33 can engage in a slot (not shown) in the housing 2, and hence can be held at a fixed distance from the coupling piece 10. The coupling piece 10 then slides via a guide surface 34 formed on the cap 28 into a recess 35 contiguous to the guide surface 34, so that the holder 6 can be pressed tight in the recess 35 under counterpressure. For removing the holder 6 from the slot, a lip 36 is provided on the plate-shaped part 33, engageable by an operator to remove the holder 6 from the housing 2. In a preferred embodiment, the plate-shaped part 33 has a transverse dimension of about 39 mm, while the lip has a longitudinal dimension of about 20 mm. The cylindrical part can have a diameter of about 15 mm and a length of about 4 mm.

Figure 8:
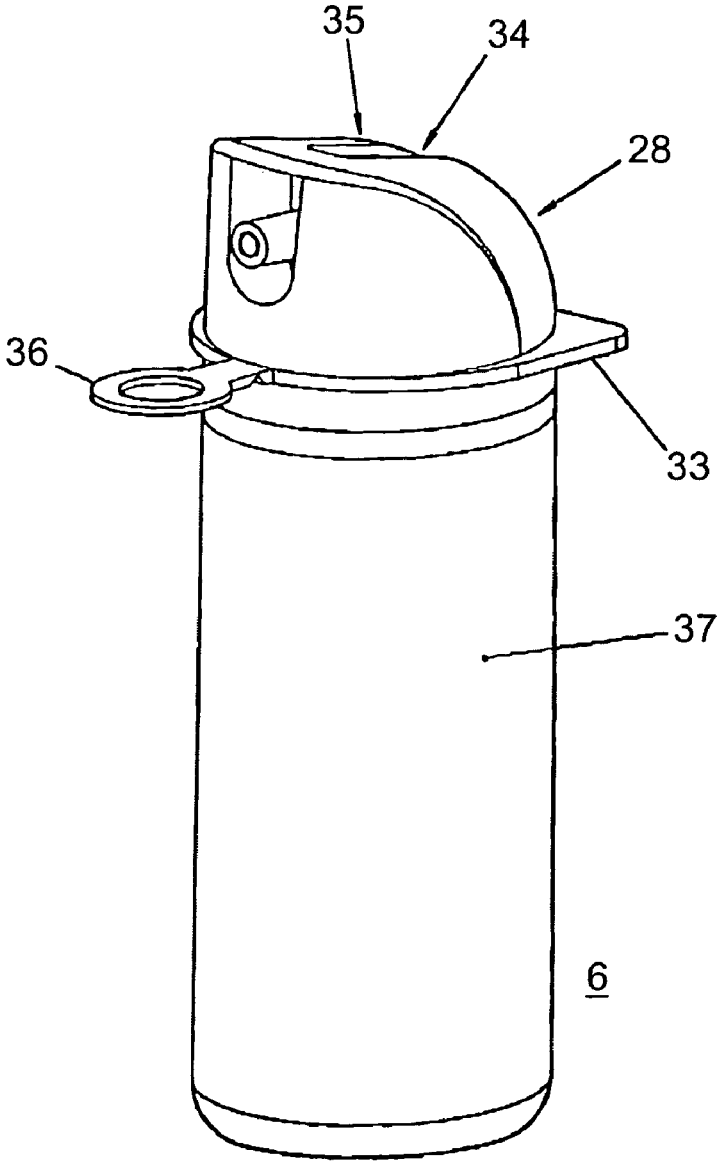
FIG. 8 is a schematic illustration of a holder for an air freshener according to the present invention.

FIG. 8 shows a preferred embodiment of a holder 6 for an air freshener according to the present invention. The holder 6 includes a cap 28 which is non-detachably connected with the holder 6. The cap 28 is of a plastic which is fixed with a special connection, as set out further with reference to FIGS. 9 and 10, to the propellant holder 37, which is filled with a liquid deodorant which is sprayed out by a propellant. On the cap 28, at the top, a run-on guide surface 34 is formed which terminates in a recess 35 contiguous thereto. The cylindrical coupling piece 10 shown in FIG. 7, when including the holder 6 in the housing 2, is pressed by way of the guide surface 32 under counterpressure into the recess 35. In a preferred embodiment, the recess 35 has a width of about 4 mm, and the coupling piece 10 is designed as a cylindrical part as represented in FIG. 8, i.e. formed as a cylinder of a length of about 4 mm and a diameter of about 15 mm. Further, the holder of FIG. 8 comprises a plate-shaped part 33 which can engage in a slot provided in the air freshener housing 2. Formed on the plate-shaped part 33 is a lip 36 which an operator can engage to remove the holder 6 from the housing 2. In a preferred embodiment, the plate-shaped part 33 has a transverse dimension of about 39 mm, and the lip 36 has a longitudinal dimension of about 20 mm.

Figure 9:
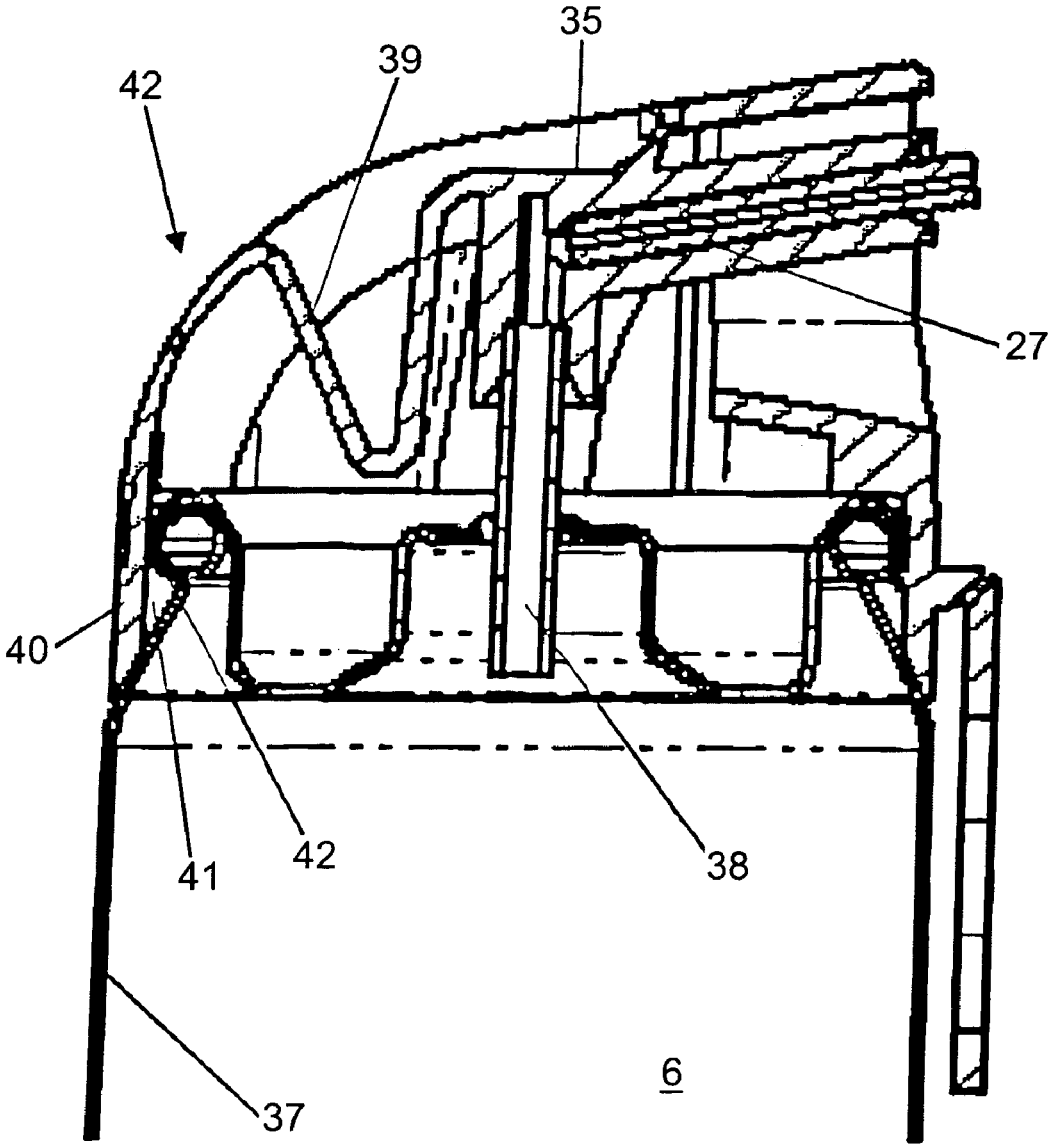
FIG. 9 is a schematic side elevation view of a holder according to another embodiment of the present invention.

FIG. 9 is a side elevation of an alternative holder 6. The holder 6 includes a cap 28 and a propellant holder 37. In the cap 28, a dispensing member 27 is provided, which is depressible and hence depresses an outlet piece 38 of the propellant holder 37. The outlet piece 38 discharges into the dispensing member 27, which in turn dispenses the spray to the surroundings. In the dispensing member 27, a recess 35 is provided into which, referring to FIGS. 5*a–c* and 7, the coupling piece 10 can be pressed. The recess 35 is contiguous to a flexible V-shaped connecting element 39 for forming a flexible suspension for dispensing member 27. Through an axial pressure of the coupling piece 10, the freely supported dispensing member 27 can perform a free axial movement. As a result, lateral forces are diverted and the outlet piece can be depressed without lateral forces, which prevents the device being blocked and reduces noise level. Upon an axial movement of the coupling piece, the recess 35, and hence the dispensing member 27, will move axially. As a result, the V-shaped part 39 will move, adjacent the lower side, in lateral direction (to the left in FIG. 9), so that the axial movement is transmitted better. The cap 28 shown in FIG. 9 is fixedly connected onto the propellant holder 37 by projections 41 provided on an inner wall of a casing 40. The casing 40 surrounds the propellant holder 37, so that the projections 41 under bias reach into a recess 42 of the propellant holder 37.

Figure 10:
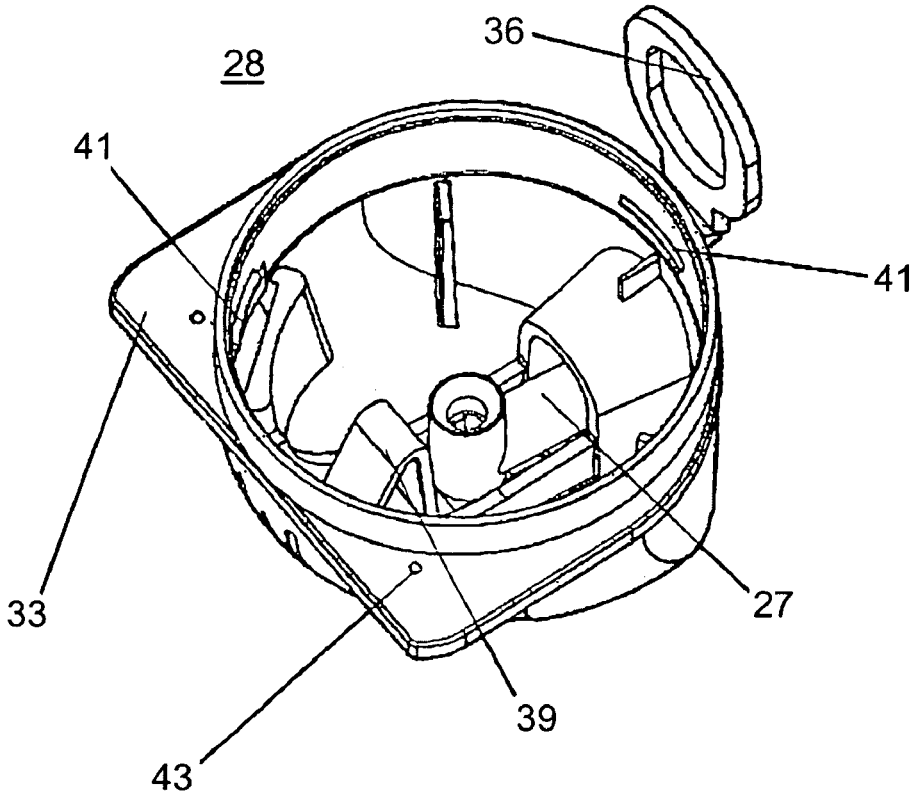
FIG. 10 is a schematic bottom view of the cap of the holder represented in FIG. 9.

The casing 40 and the projections 41 are shown in FIG. 10 in a bottom view of the cap 28. The plate-shaped part 33 encloses the casing 40 and thereby effects a very high dimensional stability of the cap 28 around the propellant holder. As a consequence, the cap can be connected substantially undetachably to the propellant holder 37. Further, the plate-shaped part 33 includes a lip 36, which reaches over an outlet piece of the dispensing member 27, so that the lip 36 cannot adversely affect the outflow of the spray from the dispensing member 27. Provided on the plate-shaped part 33 are projections 43 to be snapped tight under bias in a correspondingly shaped recess in the slot 44, as shown in FIG. 4.

Although the invention has been described with reference to the exemplary embodiments discussed above, the invention is not limited thereto, but can also comprise other variations or modifications without deviating from the spirit of the invention. Such variations are understood to fall within the scope of the following claims

What is claimed is:

1. An air freshener for dispensing a spray of deodorant, comprising:

a housing configured to be mounted on or adjacent a door, the housing including a holder configured to contain deodorant, the holder including a movable dispensing member, which upon movement dispenses a spray of deodorant from the holder;

a sliding bar having an end contactable by the door so that a door movement results in a movement of the sliding bar; and a press member, coupled with the sliding bar, having a wedge-shaped surface that during movement of the sliding bar causes the dispensing member to move in a direction transverse to the movement of the sliding bar, wherein the sliding bar comprises a guide along which the press member can be moved in a direction transverse to the sliding bar, the press member operates a coupling piece between the press member and the dispensing member, so that in operation a contact surface between the press member and the coupling piece in a first movement of the sliding bar extends substantially parallel to the guide in order to fix the press member transversely to the guide in a position remote from the sliding bar, the contact surface in a second movement, opposite to the first movement, is oriented substantially transversely to the guide, so that the press member is moved towards the sliding bar, and the coupling piece comprises a round upper side which constitutes a contact surface for the wedge-shaped press member and the guide comprises guide pins which are received in a guide slot, the guide slot is continguous to a recess in which at least one guide pin can be received, in operation the guide pin in the first movement is fixed in the recess and in the second movement is pushed from the recess into the guide slot.

2. An air freshener according to claim 1, wherein the coupling piece is rotatable and comprises an eccentric contact surface configured to contact the dispensing member.

3. An air freshener according to claim 1 or 2, wherein the coupling piece comprises a round underside which under counterpressure can be pressed into a recess of a cap of the holder.

4. An air freshener according to claim 1, wherein the housing comprises a slot configured to receive a plate-shaped part which is connected with the holder.

5. An air freshener according to claim 1, wherein the slot is configured to receive the plate-shaped part having a transverse dimension of about 39 mm.

6. An air freshener according to claim 1, wherein the coupling piece has a diameter of about 15 mm and a length of about 4 mm.

7. An air freshener according to claim 1, wherein the sliding bar is held under spring tension in one position relative to the housing.

8. An air freshener according to claim 7, wherein the spring is a leaf spring.

9. An air freshener according to claim 8, wherein the leaf spring extends between the sliding bar and the press member so that the leaf spring keeps the press member off the sliding bar.

10. A holder for containing deodorant for inclusion in a housing of an air freshener according to claim 1, comprising a cap and a propellant holder connected with the cap, the cap comprising a freely supported depressible dispensing member configured to dispense a spray from the propellant holder.

11. A holder according to claim 10, wherein the dispensing member comprises a recess in which a round underside of a coupling piece can be pressed, which recess is contiguous to a flexible connecting element that forms a flexible suspension for the dispensing member.

12. A holder according to claim 11, wherein the connecting element comprises a substantially V-shaped flexible part which forms a connection between the dispensing member and a wall of the cap.

13. A holder according to claim 11, characterized in that the recess has a width of about 4 mm, to receive a round coupling piece of a length of about 4 mm and a diameter of about 15 mm.

14. A holder according to claim 10, wherein the cap comprises a plate-shaped part which can engage in a slot provided in an air freshener housing.

15. A holder according to claim 14, wherein the plate-shaped part encloses a casing which surrounds the propellant holder, on the inner wall of the casing, projections are arranged which reach under counterpressure into a recess of the propellant holder.

16. A holder according to claim 14, wherein the plate-shaped part comprises a lip which an operator can engage to remove the holder from the housing.

17. A holder according to claim 16, wherein the lip reaches over an outlet piece of the dispensing member.

18. A holder according to claim 14, wherein the plate-shaped part comprises projections to be snapped tight under bias in a correspondingly shaped recess in the slot.

19. A holder according to claim 14, wherein the plate-shaped part has a transverse dimension of about 39 mm, and that the lip has a longitudinal dimension of about 20 mm.

20. A method for dispensing a spray of deodorant, comprising:

placing a holder provided with a movable dispensing member, which upon movement dispenses a spray of deodorant from the holder, in a housing for mounting on or adjacent a door;

moving, with the aid of a door movement, a sliding bar received in the housing and having an end in contact with the door or doorway, so that a door movement results in a movement of the sliding bar;

providing a coupling piece between a press member, having a wedge-shaped surface and coupled with the sliding bar, and the dispensing member; wherein the coupling piece comprises a round upper side which forms a contact surface for the wedge-shaped press member;

fixing the press member, in a first movement of the sliding bar, in a position remote from the sliding bar in order to move the dispensing member in a direction transverse to the movement of the sliding bar, for dispensing the spray; and moving the press member towards the sliding bar in a second movement proceeding opposite to the first movement, wherein the sliding bar comprises a guide along which the press member can be moved in a direction transverse to the sliding bar, the press member operates the coupling piece between the press member and the dispensing member, so that in operation a contact surface between the press member and the coupling piece in a first movement of the sliding bar extends substantially parallel to the guide in order to fix the press member transversely to the guide in a position remote from the sliding bar, the contact surface in a second movement, opposite to the first movement, is oriented substantially transversely to the guide, so that the press member is moved towards the sliding bar, and the coupling piece comprises a round upper side which constitutes a contact surface for the wedge-shaped press member and the guide comprises guide pins which are received in a guide slot, the guide slot is contiguous to a recess in which at least one guide pin can be received, in operation the guide pin in the first movement is fix in the recess and in the second movement is pushed from the recess into the guide slot.

* * * * *